US007752692B1

(12) United States Patent
Sanders et al.

(10) Patent No.: US 7,752,692 B1
(45) Date of Patent: Jul. 13, 2010

(54) PILLOW CONVERTIBLE TO A BABY CHANGING PAD

(76) Inventors: Natalie C. Sanders, 488 Dorset Way, Salinas, CA (US) 93906; Glen Sanders, 488 Dorset Way, Salinas, CA (US) 93906

( * ) Notice: Subject to any disclaimer, the term of this patent is extended or adjusted under 35 U.S.C. 154(b) by 0 days.

(21) Appl. No.: 12/460,992

(22) Filed: Jul. 28, 2009

(51) Int. Cl.
*A47D 13/00* (2006.01)
*A47G 9/06* (2006.01)

(52) U.S. Cl. ..... 5/655; 5/417; 5/420

(58) Field of Classification Search ..... 5/417, 5/419, 420, 655, 639, 640, 645, 485
See application file for complete search history.

(56) References Cited

U.S. PATENT DOCUMENTS

| | | | | |
|---|---|---|---|---|
| 3,176,315 | A * | 4/1965 | Freund | 2/69 |
| 4,516,668 | A * | 5/1985 | Grayek | 190/2 |
| 4,575,369 | A | 3/1986 | Grayek | |
| 5,199,120 | A | 4/1993 | Holmes | |
| 5,457,829 | A * | 10/1995 | Elliott | 5/420 |
| D376,689 | S * | 12/1996 | Doppelt | D3/274 |
| 5,774,912 | A * | 7/1998 | Dominique | 5/419 |
| 6,298,509 | B1 * | 10/2001 | Vickers | 5/655 |
| 6,393,638 | B1 * | 5/2002 | MacColl | 5/419 |
| 6,408,462 | B1 * | 6/2002 | Moore | 5/417 |
| 7,516,500 | B2 | 4/2009 | Akkad | |
| 2004/0123386 | A1 * | 7/2004 | Higashi et al. | 5/420 |
| 2005/0081297 | A1 * | 4/2005 | Woodward et al. | 5/655 |
| 2006/0032881 | A1 | 2/2006 | Price et al. | |
| 2006/0289582 | A1 | 12/2006 | Killilea | |
| 2007/0122066 | A1 | 5/2007 | Landay | |
| 2007/0142809 | A1 | 6/2007 | Pimm | |
| 2007/0272588 | A1 | 11/2007 | Longacre | |
| 2007/0289986 | A1 | 12/2007 | Lake et al. | |
| 2008/0027403 | A1 | 1/2008 | Hernandez et al. | |
| 2009/0114690 | A1 | 5/2009 | Landay | |

* cited by examiner

*Primary Examiner*—Michael Trettel
(74) *Attorney, Agent, or Firm*—Schneck & Schneck; Thomas Schneck

(57) ABSTRACT

A baby changing apparatus in a pillow is disclosed. A flexible pad unfolds lengthwise from a pocket. The pad has a plurality of parallel, joined folding sections. A pillow-forming section is one of the sections, at a first end of the pad. The pillow-forming section has fabric defining the pocket. The pillow-forming section may be openable towards an opposing second end of the pad. A stowage section is one of the sections. The stowage section has a first storage volume. The stowage section may have a second storage volume. The opened pillow-forming section may receive the remaining folded sections folded and inserted to form the pillow. The pad may fold such that the pillow-forming section receives the remaining or residual folding sections tucked into the pocket to form the pillow. The folding sections may include a first middle section, and may include an adjacent second middle section.

7 Claims, 7 Drawing Sheets

PILLOW CONVERTIBLE TO A BABY CHANGING PAD

TECHNICAL FIELD

The field of the present invention relates generally to equipment for baby care and, more specifically, to a pillow that converts to a changing pad.

BACKGROUND

Venturing out of the home with a baby can be a daunting challenge for a parent. Babies have many needs and require constant care. A large number of products are available on the open market for baby care. Selecting just which products to bring along, and figuring out how to transport them without misplacing any can be overwhelming. Frequent returns to an automobile packed with baby care items are a normal occurrence for any parent attempting to run errands with a baby. Struggling with bulky or overflowing bags of baby care items can make even a small trip out to a restaurant loom large with logistics, rendering it an infrequent event, to the detriment of parental bliss.

One popular product for carrying baby care items is the change bag, which may be a backpack, satchel or shoulder bag. A baby changing pad is available separately, or may be sold packaged with or within, and removable from, the change bag. Diapers, bottles, formula, a package of baby wipes, a towel, garments for changing, a hat, a small blanket and more can often fit in the change bag. Many parents own more than one change bag, perhaps having a larger one stuffed with more items for longer outings or more contingencies, and a smaller one with fewer items for shorter outings.

If breast-feeding a baby, a mother may not need to bring along a bottle, formula, an ice pack or other related bottle-feeding items. She may wish to bring along a nursing pillow, upon which to rest an infant's head while breast-feeding.

If bottle feeding a baby, a parent may still wish to bring along a pillow, for resting the baby's head. An exhausted mother may wish to rest her own head upon a pillow, while the father holds the baby, or vice versa.

For a short outing, such as to a restaurant or a brief visit at a friend's home, a parent with a baby may wish to bring in only a few baby care items, such as for a single baby change or nursing. A list of such items might include a diaper, a baby changing pad, a spare baby garment and some baby wipes. A parent, especially a breast-feeding mother, may wish to bring along a small pillow. A larger collection of baby care items may be left in the car and retrieved if needed.

An object of the invention is to combine diverse baby care equipment into a single article.

SUMMARY

The above object has been met with a baby changing apparatus that is a pillow convertible to a baby changing pad, wherein a flexible pad folds into a fabric pocket forming the pillow. The flexible pad has a plurality of parallel, joined folding sections. One of the sections, at a first end of the pad, is a pillow-forming section. The pillow-forming section has fabric stitched so as to receive the folded flexible pad to form the pillow. A further section at an opposite end of the pad is a stowage section. The stowage section has an opening in an otherwise closed section for storage of baby items.

A middle section may be included in the folding sections. The folding sections may be foldable in an overlapping, alternating, zigzag or double fold manner.

The folding sections may join and fold at fold lines defined by stitching. A further middle section may be included in the folding sections.

The pillow-forming section may be at a first end of the pad and be openable towards an opposing second end of the pad. The pillow-forming section acts as part of the pad when open, but when receiving the remaining folding sections forms the pillow.

A pocket forming fabric piece is attached to the pillow-forming section of the flexible pad so as to form a pocket, making the pillow-forming section openable. The pillow-forming section may be the only visible section when the remaining sections of the pad are folded into the pocket.

A first surface of the pad may be liquid resistant, such as soft vinyl, plastic or canvas. An opposing second surface of the pad may be made of a first woven fabric. The pocket fabric piece is a portion of the pocket. The pocket fabric piece may be made of a second fabric, or the first fabric. The pocket fabric piece forms a portion of the outside of the pillow. A portion of the second surface of the pad may form a portion of the outside of the pillow.

At least a center region of a folding pad section is stitched to enclose padding material. The padding may thin where the folding sections join. At least one folding section may have a resilient material between the first surface of the pad and the second surface of the pad. At least one folding section may have a foam sheet between a first and second surface of the pad. The first and second surfaces of the pad may be attached between the folding sections, near the fold lines. Stitching may be between the folding sections. Stitching may be through the first and second surfaces of the pad. Stitching may define the fold lines. Stitching may at least partially secure a foam sheet that forms padding.

The pad may be notched at the edges where the folding sections join. The notches ease folding at the fold lines and contribute to a more rounded pillow.

The first storage volume, in the stowage section, may be sealable as with a hinged or screwed on lid. The first storage volume may be configured to removably contain baby wipes, tissue or ointment. There may be a second openable storage volume in the stowage section. The second storage volume may be securable, as with a fastener or lockable lid.

The second storage volume may be configured to removably contain a diaper, a baby garment or a nursing cover. The nursing cover may have a neck strap, a boning and a curved apron.

The pillow may have a handle or a shoulder strap. The shoulder strap may be adjustable.

DETAILED DESCRIPTION

Figure 1:
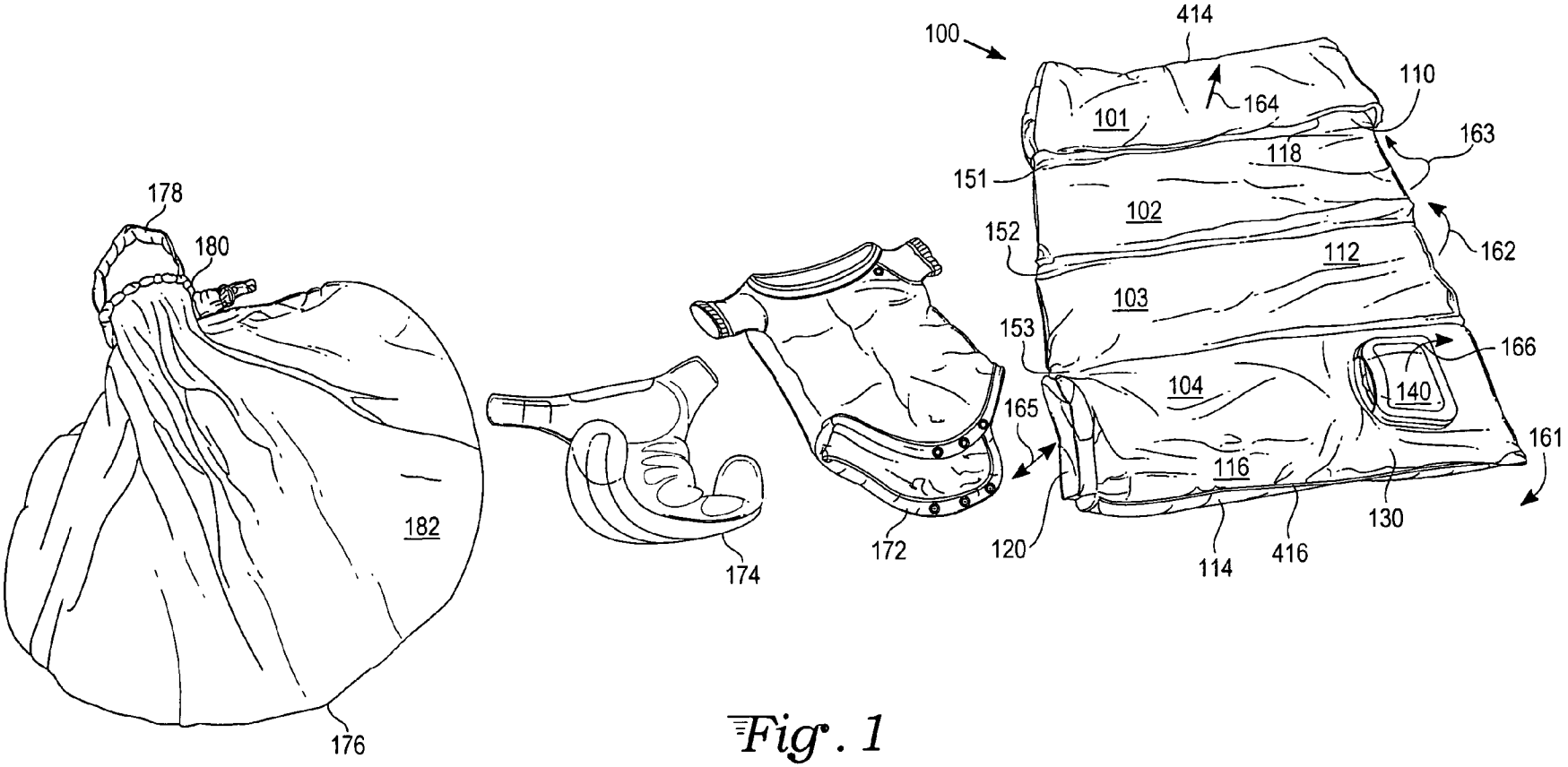
FIG. 1 shows an exploded view of a baby changing apparatus in a pillow in accordance with the invention.

With reference to FIG. 1, an exemplary baby changing apparatus in a pillow 100 includes a select few baby care items carried in a specialized, convertible container. The specialized, convertible container is itself useful, as it is a pillow suitable for resting a baby or parent's head.

The pillow is formed in a pocket 110 that contains a folded baby changing pad 112 operating as the filler of the pillow. A first storage volume 130 of the pad and a second storage volume 120 may hold various contents. A baby garment 172, a diaper 174 and a nursing cover 176 may be placed in the second storage volume 120.

A nursing mother may place the strap 178 of the nursing cover 176 over her head and around the back of her neck. The curved apron 182 of the nursing cover 176 may be discreetly arranged by the mother as she breast-feeds her baby.

Boning 180, hemmed in or otherwise attached along the neckline of the nursing cover and forming a half circle below the mother's chin, may be discreetly lifted by the mother so that she may check on her infant. The boning 180 may be a flexible or elastic shape retaining material, which gives the mother better control over the lifting of the nursing cover when peeking. A rounded shape of the apron 182 of the nursing cover 176 provides fabric to the right and left sides of the mother, so she can tuck or move the fabric around for privacy.

Figure 2:
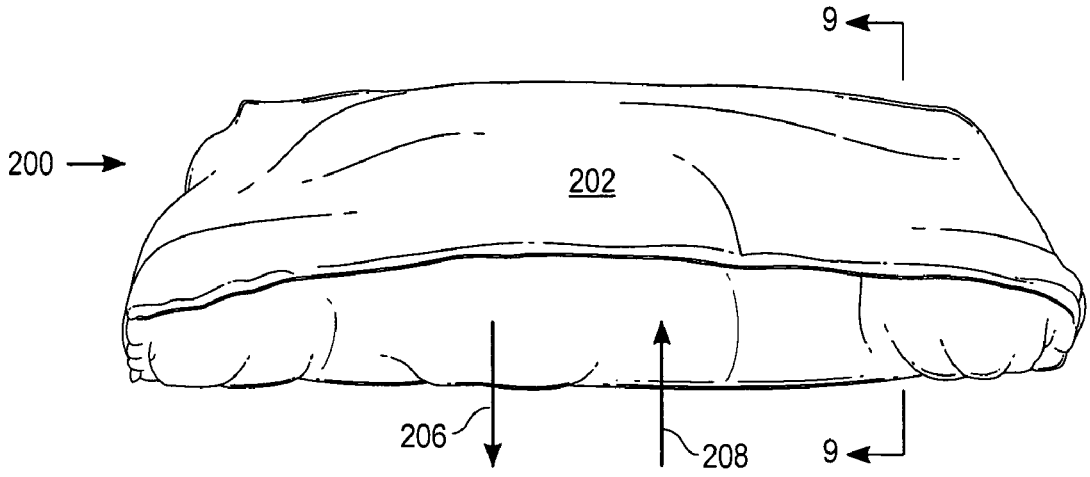
FIG. 2 shows a plan view of the pillow of FIG. 1, as formed by folding.

In FIG. 2 the baby changing apparatus is converted to a pillow 200 formed by folded, tucked pad sections. Folded sections of the pad may be pulled out of a pocket in the pillow 200. The folded sections of the pad are pulled in a pillow unfolding direction 206 when unfolding the pillow 200 to form the pad. A pocket fabric piece 202, attached to the body of the pillow, is a portion of the receiving pocket.

Figure 9:
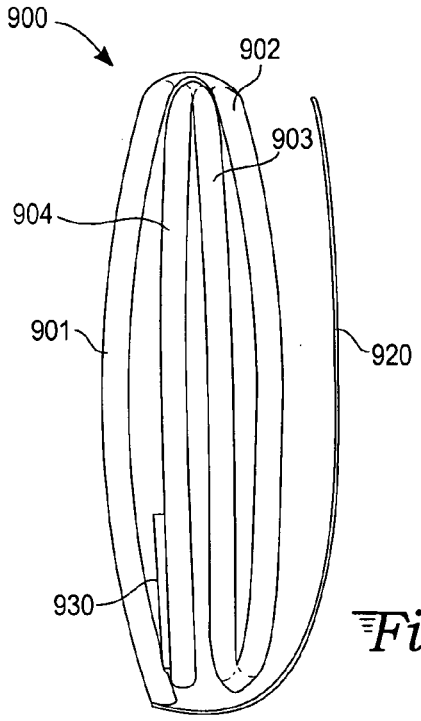
FIG. 9 is a cross-section view of the pillow of FIG. 2, showing the sections of the pad as folded and tucked with the folding sequence of FIGS. 6-8.

When forming the pillow 200, the pad sections are folded and inserted or tucked into the pocket in a pillow forming direction 208. A cross-section view of the pillow 200, revealing the folded sections, is shown in FIG. 9 and will be discussed in greater detail along with a folding sequence.

Figure 3:
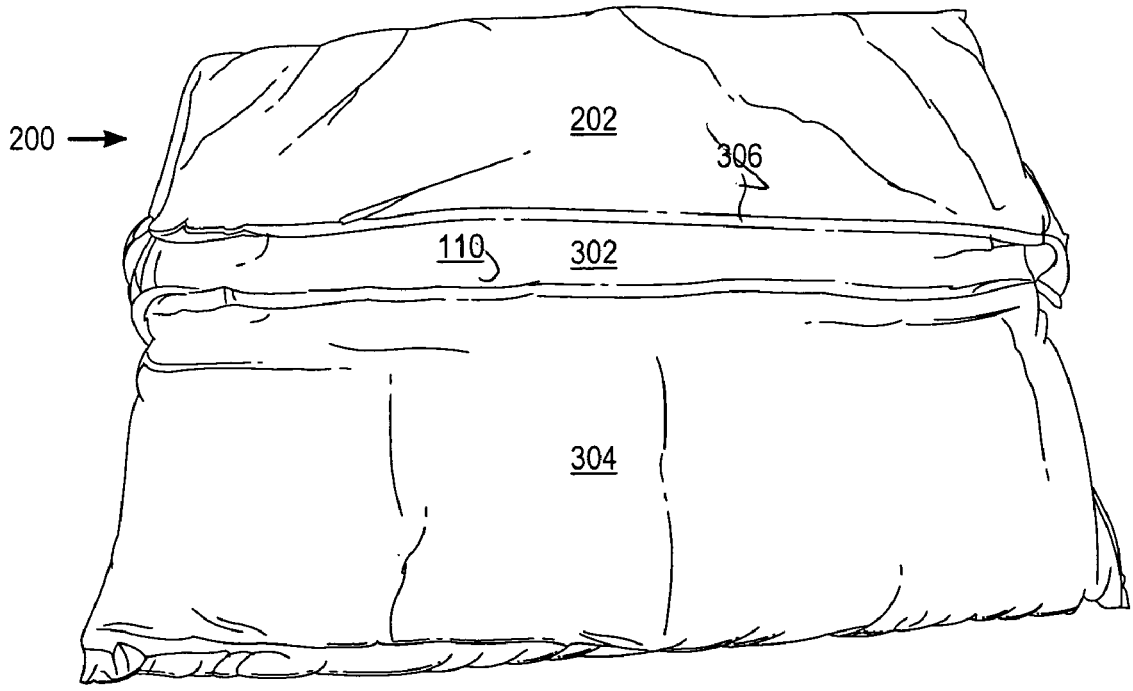
FIG. 3 depicts the pillow of FIG. 2 showing folding pad sections pulled from the pocket of the pillow-forming section, ready to continue unfolding to form the pad.

In FIG. 3 folded sections 304 are pulled from the pocket 110. The pocket piece 202 may be made of fabric or an elastic material or may be fabric with an elastic band 306. Expandability of the elastic material or band may allow for ease of tucking the folded sections 304 into the pocket 110, or flexibility in the total volume of items stowed in a storage volume. Expandability of the elastic material or band may further allow for ease of pulling the pocket piece 202 around the folded sections 304.

In FIG. 3, the folding pad sections 304 are partially deployed from the pillow 200, and are ready to continue unfolding to form the pad 112. The sections 304 are also depicted folded and ready to tuck into the pocket 110, to form the pillow 200.

Figure 4:
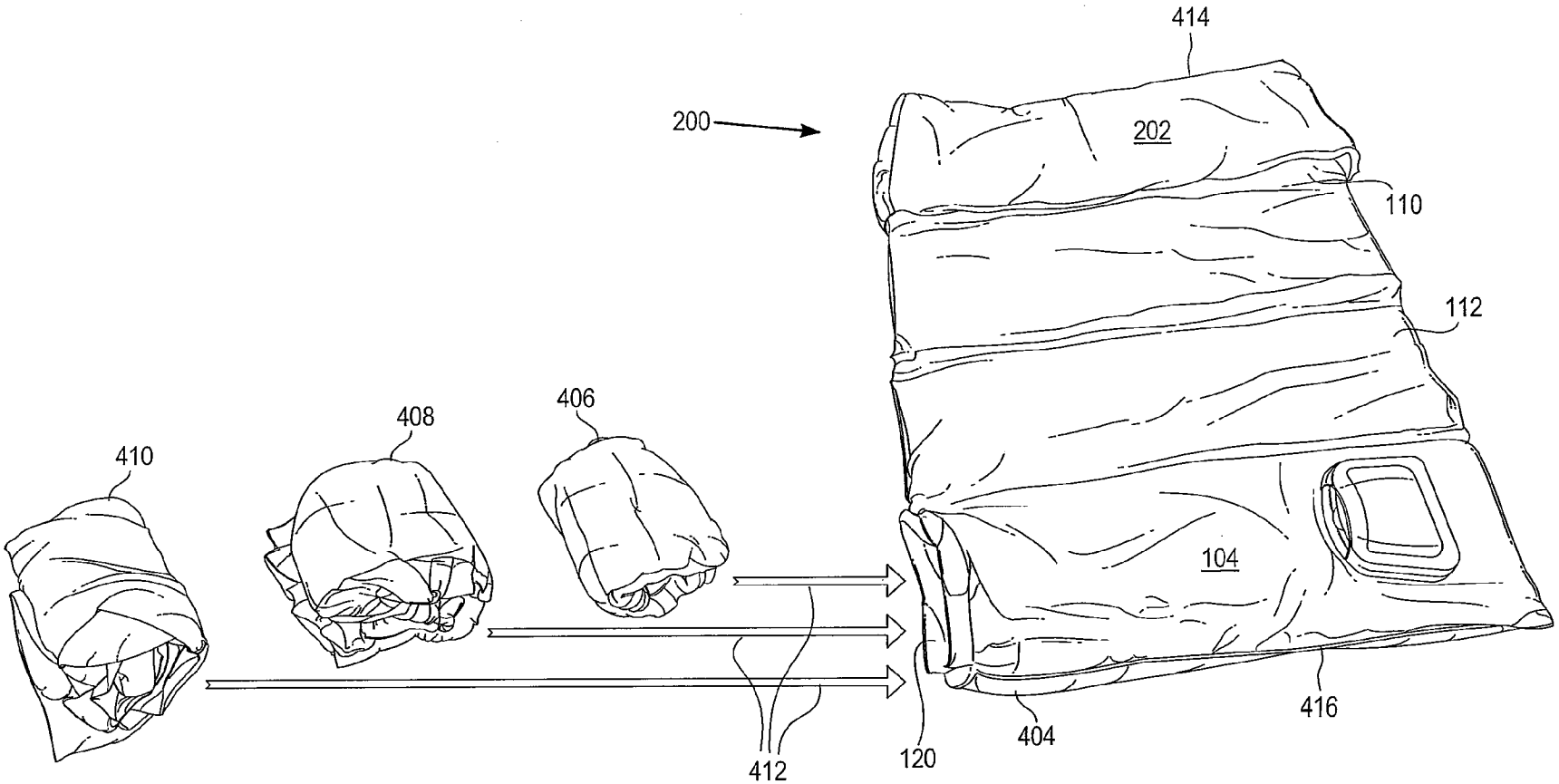
FIG. 4 shows a plan view of the apparatus of FIG. 3, as unfolded from the formed pillow, showing the pad with three baby care items rolled and ready to stow in a storage volume in the stowage section.

In FIG. 4 the pad 112 is seen to be unfolded from the formed pillow 200. The pocket 110 and pocket piece 202 are visible at a first end 414 of the pad 112. The pocket opens towards an opposed second end 416 of the pad 112. Three baby care items 406, 408 and 410 are shown rolled and ready to stow, as pointed to by arrows 412, in a second storage volume 120 in the stowage section 104 of the pad 112.

Returning to FIG. 1, various characteristics and operating actions of an embodiment of a baby changing apparatus in a pillow 100 are shown. A pocket 110 in a pillow-forming section 101 may be opened in a pocket opening direction 164. The pillow-forming section 101 is at the first end 414 of the pad 112 and is openable towards the opposing second end 416 of the pad 112.

Folding sections 101, 102, 103 and 104 are joined and fold at fold lines 151, 152 and 153, which can be stitched regions that divide the folding sections. The folding sections are rectangular and parallel to each other. The pillow-forming section 101 is one of the folding sections. The stowage section 104 is a further one of the folding sections. Although the stowage section 104 may be at the second end 416 of the pad 112, the stowage section 104 may also be located farther from, closer to or adjacent to the pillow-forming section 101. The stowage section 104 may be other than an end section. An embodiment may have one or more middle sections 102 and 103; disposed between the stowage section 104 and the pillow-forming section 101. Other sections may have storage volumes.

In the stowage section 104, the first storage volume 130 may hold baby wipes, which are often available premoistened. In order to retain the moisture, a sealable lid 140 such as a hinged lid, screwed on lid or hatch is preferred. The lid 140 may be openable in a lid opening direction 166. Opening the lid 140 allows the baby wipes to be dispensed, withdrawn or removed. The first storage volume 130 and the lid 140 may be part of the stowage section 104 and allow baby wipes to be inserted and removed from the first storage volume 130, which may be moisture resistant. The first storage volume 130 may hold a removable container with the lid 140. Such a removable container may hold baby wipes and be replaceable. Tissue or ointment may be stored and dispensed from the first storage volume 130, in a further embodiment.

In the stowage section 104, the second storage volume 120 may be openable and securable. The second storage volume 120 may be a type of storage pocket, for example, and be openable, in a second storage volume opening direction 165, near a side edge of the pad 112. A fastener such as hook and loop strips, a zipper, snap buttons, a clamp, a lockable lid and or a fold over fabric may serve to secure the second storage volume 120 and any contents thereof.

Except for disposable types, most baby changing pads are cleanable and reusable. In order to achieve this goal, a first surface 116 of the pad 112 in an embodiment may be liquid resistant. Soft vinyl, plastic, canvas or other flexible material may be used. The pad is usually placed with the liquid resistant first surface 116 facing up, and the baby is changed upon this surface.

An opposing second surface 114 of the pad 112, which usually faces downward during baby changing, may be made of a fabric. A portion of the first surface 116, at the pillow-forming section 101, forms a pocket backing 118. The pocket piece 202 is attached to the pillow-forming section 101, so that the pocket piece 202 and the pocket backing 118 form the pocket 110. The pocket piece 202 and a portion of the second surface 114 of the pad 112, at the pillow-forming or first end 414 of the pad 112, form part of the outside of the pillow 200. The pocket piece 202 may also be made of a fabric, which may be the same type of fabric as, or similar to, or different from the fabric of the second surface 114 of the pad 112. Since a portion of the second surface 114 of the pad 112 and the pocket piece 202 are on the outside of the pillow 200, the fabric or fabrics may be chosen for a comfortable feel and a pleasant appearance of the pillow 200, and may be matched or contrasted in color and pattern. The pad 112 may be used as a sleeping mat for the baby, by placing the pad with the second surface 114 facing upward.

For the comfort of the baby, the pad 112 may be at least partially padded. One or more of the folding sections may be padded in at least a center region. In an embodiment, the pillow-forming section 101 and middle sections 102 and 103 are padded, and the stowage section makes use of the softness of the contents for padding or goes without padding if empty. In an embodiment, foam sheets, cut to size, are used for padding. A washable foam may be used for padding. Batting may be used for padding. Another resilient material may be used for padding.

For ease of folding, the pad 112 may thin where the folding sections join, at the fold lines 151, 152 and 153. To achieve this thinning, the first 116 and second 114 surfaces of the pad 112 may be attached to each other at or near the fold lines, between the folding sections. In an embodiment, stitching between the folding sections defines the fold lines 151, 152 and 153. The stitching goes through the first 116 and second 114 surfaces of the pad. Foam sheets in sections 101, 102 and 103 are secured by the stitching along the fold lines 151, 152 and 153 and by stitching attaching the first surface 116 to the second surface 114 around the edges of the pad 112. Other means of thinning, attaching or securing the surfaces or defining the fold lines may be employed. Other means of securing a foam sheet, a resilient material or padding may be employed.

Figure 5:
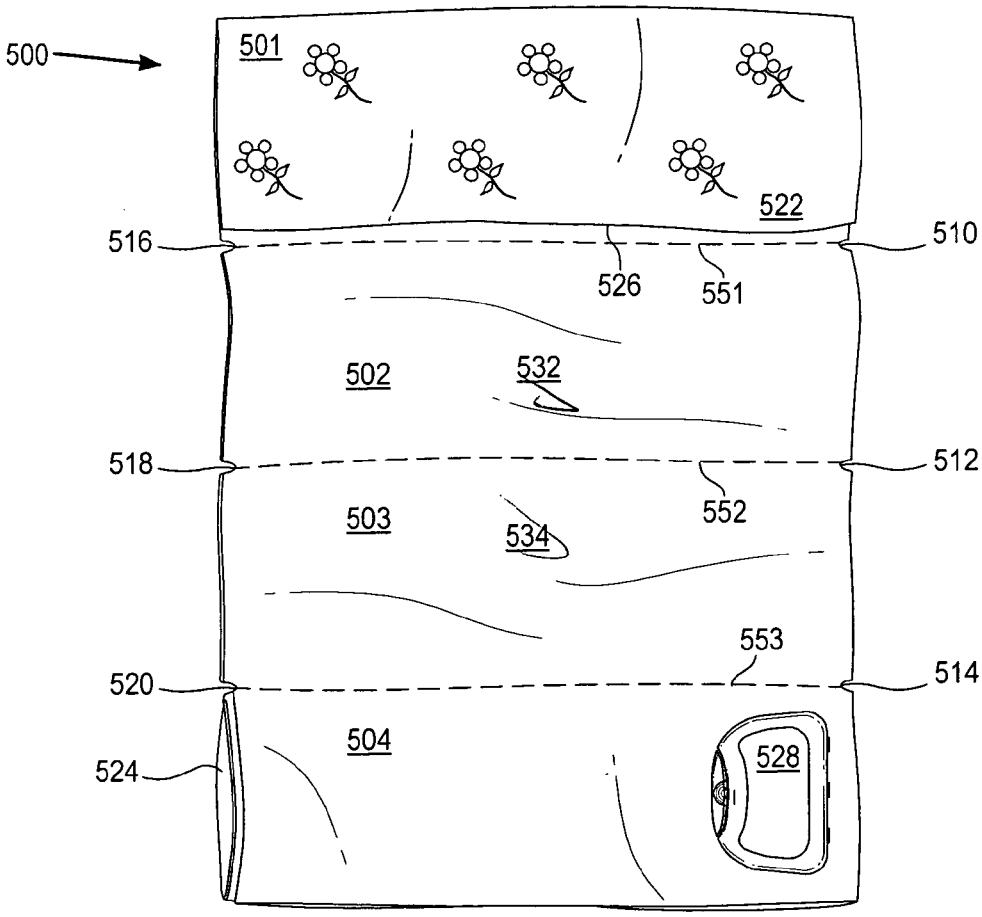
FIG. 5 shows an alternate embodiment of a baby changing pad convertible to a pillow, with the pad having notches at fold lines.

FIG. 5 shows a further embodiment of a baby changing apparatus in a pillow 500. Folding sections 501, 502, 503 and 504 are joined and fold at fold lines 551, 552 and 553. Notches 510, 512, 514, 516, 518 and 520 along opposing edges of the pad 532, at the fold lines 551, 552 and 553 where the folding sections 501, 502, 503 and 504 join, make folding the pad 532 easier. The notches, which may be V-shaped cuts in an edge, further contribute to a rounding of the pillow. A first storage volume in the stowage section 504 has a replaceable wipe container with a snapping lid 528. A second storage volume 524 is in the stowage section 504. Pocket piece 522 forms a portion of the pocket 526. Pocket piece 522 is a fabric that is folded over a vinyl side 534 of the pad 532 and used to tuck the sections 502, 503 and 504 in.

Figure 6:
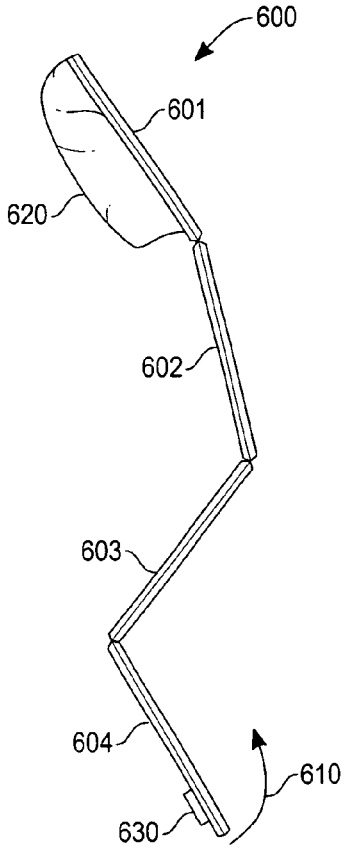
FIG. 6 is a profile view of an embodiment of a baby changing apparatus in a pillow, indicating fold directions for the pad at the start of a folding sequence.

FIG. 6 is a profile view of an embodiment 600. Fold directions for the pad, at the start of a folding sequence, are indicated. Three of the sections start out as an alternating or zigzag fold. Directions are herein given with regard to a pad with the pocket piece 620 and the lid 630 facing upwards. Stowage section 604, shown with a lid 630, is folded downward or under a second middle section 603, in a downward or under direction 610.

Figure 7:
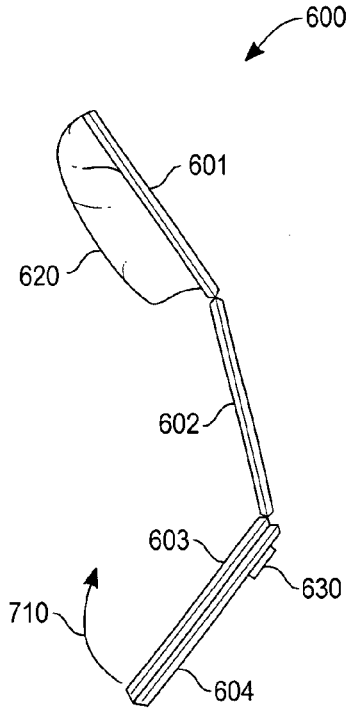
FIG. 7 is a profile view of the embodiment of FIG. 6, continuing the folding sequence.

FIG. 7 continues the folding sequence. Stowage section 604 and second middle section 603 are folded upward or on top of first middle section 602, in an upward or on top direction 710.

Figure 8:
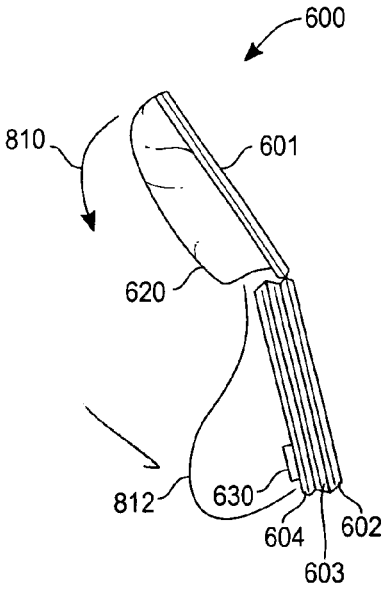
FIG. 8 is a profile view of the embodiment of FIG. 6, finishing the folding sequence. Folded sections are shown ready to be tucked into the pocket to form the pillow.

FIG. 8 finishes the folding sequence. FIG. 8 shows an embodiment in a state similar to one shown in FIG. 2. The pillow-forming section 601 is folded over the three folded sections 604, 603 and 602 in a folding over direction 810, and the pocket piece 620 is pulled around the folded sections. The pillow is thereby formed.

In a variation of the finish of this folding sequence, the three folded sections 604, 603 and 602 are folded and tucked into the pillow-forming section, under the pocket piece 620, in a folding and tucking direction 812. A combination of pushing the folded sections into the pocket and pulling the pocket piece 620 around the folded sections may also be used.

An end result of a folding sequence or a variation is that the overlapping folded sections are tucked or otherwise inserted into the pocket to form the pillow. The pillow-forming section may be the only section still visible when the remaining sections of the pad are folded into the pocket.

Unfolding the pillow to form a baby changing pad may be performed in an unfolding sequence, which is a reversal of a folding sequence. An end result of an unfolding sequence is that the folding sections are unpacked from the pillow and the sections are unfolded to form the pad.

FIG. 9 shows a cross-section view of a pillow 900 similar to that of FIG. 2. Pocket piece 920, part of the pillow-forming section 901, is seen securing the remaining or residual folding sections. Stowage section 904, shown with lid 930, and middle sections 903 and 902 are shown folded in a zigzag or alternating manner, then roll folded and tucked into the pocket. Equivalently, the pocket is shown pulled around the folding sections. Following the folding sequence of FIGS. 6-8 results in a pillow 900 with the cross-section view of FIG. 9. In this folding sequence, the sections are folded in a zigzag followed by a roll fold.

A further folding sequence, using a double fold technique, achieves the same end result as shown in FIG. 9. With reference back to FIG. 1, the second end 416 of the pad 112 is folded to meet the first end 414 of the pad 112, thus folding the pad in half along fold line 152. The pad 112 is folded in half again, along fold lines 153 and 151, bringing fold line 152 over to meet the first end 414 and the second end 416 of the pad 112. Pocket fabric piece 202 is then lifted around the folded sections 102, 103 and 104, securing them within the pocket 110 and forming the pillow 900 shown in the cross-section view of FIG. 9.

Figure 10:
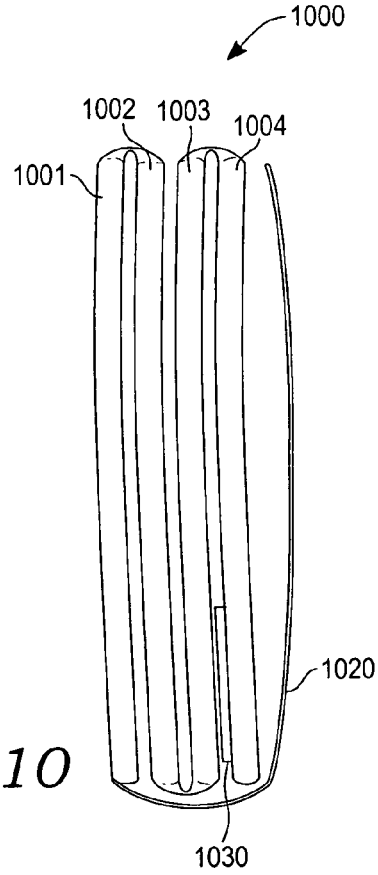
FIG. 10 is a cross-section view of the pillow of FIG. 2, showing the sections of the pad as folded with a further folding sequence and tucked into the pocket to form the pillow.

FIG. 10 shows a cross-section view of a pillow 1000 similar to that of FIG. 9 as related to FIG. 2, with the pad folded in a further folding sequence. Pocket piece 1020, part of the pillow-forming section 1001, is seen securing the remaining folding sections. Stowage section 1004, shown with lid 1030, and middle sections 1003 and 1002 are shown folded in a zigzag or alternating manner, then roll folded and tucked into the pocket. Equivalently, the pocket piece 1020 is shown pulled around the folding sections. In this further folding sequence, all of the sections are folded in a zigzag manner. Folding the initial segments of the pad in opposite directions from the folding sequence of FIGS. 6-7 results in a pillow 1000 with the cross-section view of FIG. 10. This folding sequence leaves a visible gap between pairs of folded sections (not shown in FIG. 2). The visible gap is shown in FIG. 10 as between folding sections 1002 and 1003.

Figure 11:
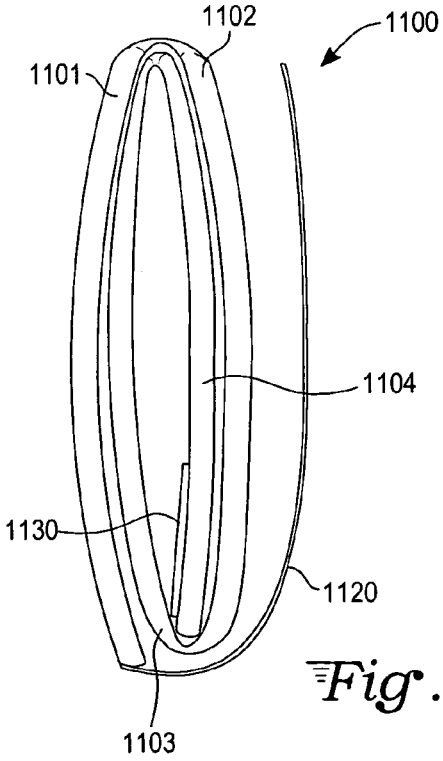
FIG. 11 is a cross-section view of the pillow of FIG. 2, showing the sections of the pad as folded with a still further folding sequence and tucked into the pocket to form the pillow.

FIG. 11 shows a cross-section view of a pillow 1100 similar to that of FIG. 9 as related to FIG. 2, with the pad folded in a still further folding sequence. Pocket piece 1120, part of the pillow-forming section 1101, is seen securing the remaining folding sections. Stowage section 1104, shown with lid 1130, middle sections 1103 and 1102 and pillow-forming section 1101 are shown folded in a spiral manner, then roll folded and tucked into the pocket. Equivalently, the pocket piece 1120 is shown pulled around the folding sections. In this further folding sequence the sections are not folded in a zigzag manner, rather they are folded upward one after the other in a spiral rolling manner. Similarly to the results of the folding sequence applied to produce the pillow 900 of FIG. 9, and unlike the folding sequence applied to produce the pillow 1000 of FIG. 10, the folding sequence applied to produce the pillow 1100 of FIG. 11 leaves no visible gap between pairs of folded sections, and produces a pillow similar in external appearance to that seen in FIG. 2.

With reference back to FIG. 1, the folding and tucking sequence of FIGS. 6-8 resulting in a pillow having the cross-section view of FIG. 9 may be visualized. Stowage section 104 is folded in a downward direction 161, underneath second middle section 103. Second middle section 103 and stowage section 104 are folded in an upward direction 162, on top of first middle section 102. The three folded sections 104, 103 and 102 are folded upwards and tucked, in an upwards and tucking direction 163, into the pocket 110 in the pillow-forming section 101 while the pillow-forming section 101 is opened in a pocket opening direction 164. The pocket piece 202 may be pulled around the folded sections 104, 103 and 102.

Figure 12:
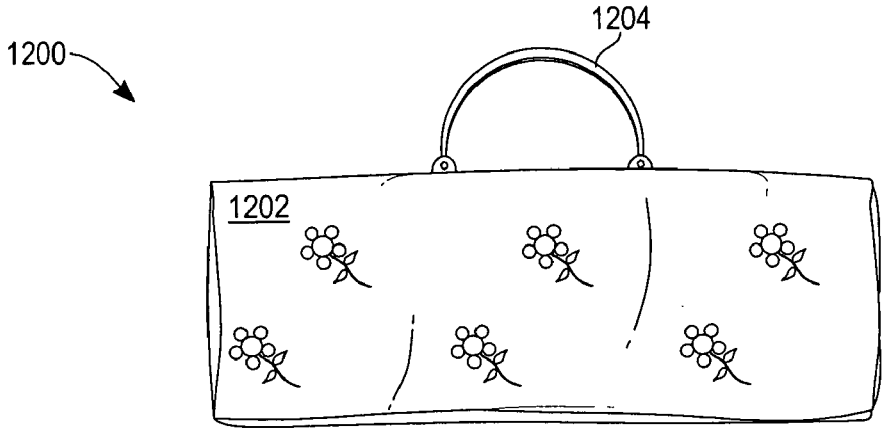
FIG. 12 shows an alternate embodiment of the apparatus of FIG. 1 as a pillow with a handle.

FIG. 12 shows an embodiment of a baby changing apparatus in a pillow 1200. The pillow 1202 has a handle 1204. The handle may be attached near where the pocket piece attaches to the pillow-forming section, near the fold line between the pillow-forming section and an adjacent section, to the pocket piece, to the pillow-forming section or at a location devised by a person skilled in the art.

Figure 13:
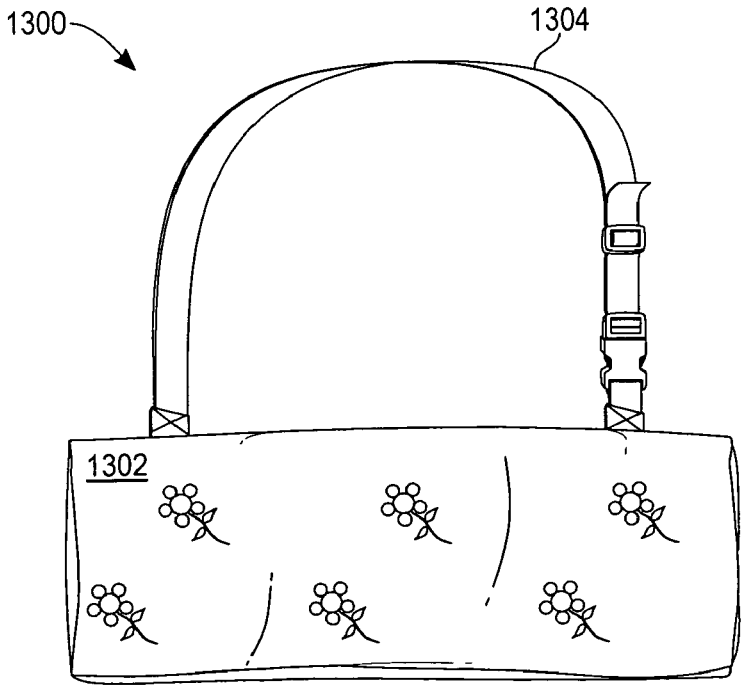
FIG. 13 shows an alternate embodiment of the apparatus of FIG. 1 as a pillow with an adjustable shoulder strap.

FIG. 13 shows an embodiment of a baby changing apparatus in a pillow 1300. The pillow 1302 has a strap 1304. The strap may be adjustable. The strap may be a shoulder strap. The strap may be attached near where the pocket piece attaches to the pillow-forming section, near the fold line between the pillow-forming section and an adjacent section, to the pocket piece, to the pillow-forming section or at a location devised by a person skilled in the art.

Further embodiments may have additional storage volumes, fewer or additional sections, some sections with or without foam or padding, and various sizes and dimensions. An embodiment may have one or more pockets added and accessible when formed as the pillow. An embodiment may include a cover for the pillow, which protects the material and is stored in a storage volume when not covering the pillow.

A further embodiment with six folding sections and a suitably sized pocket forms an extra large pillow. Two of the sections contain storage volumes for holding a pacifier, baby clothes, nursing cover, wipe case, diapers, nursing pads, diaper rash cream or other articles. Four of the sections have foam as padding.

In order to produce an embodiment, the following method may be used. Cut fabric for the pocket piece and a long piece of cloth for the cloth surface. Cut vinyl for the liquid resistant surface. Install the lid in the vinyl, or make an arrangement in the vinyl for a removable container with a lid. Hem the overhang of the pocket piece. Attach the pocket piece to the long piece of cloth. Turn the material on the so-called wrong side, and sew the vinyl and cloth together as well as the top of the pocket piece that attaches to the pillow-forming section. Leave one long side open. Turn the work right side out. Insert each foam piece, one at a time, from the open long side. Sew adjacent to the foam piece to create a section. Repeat, for each foam piece. Sew the long sides together, excluding the last section. The last section is the stowage section, with one portion remaining openable to the side. Attach a hook and loop fastener or other fastener for securing the second storage volume of the stowage section. Additional construction details for elastics, fasteners, liners, fabric handling, variations, sewing or other attaching techniques and finishing touches are omitted but may be devised by a person skilled in the art. Techniques other than sewing and stitching may be used, for example thermal bonding. Materials other than fabric, woven fabric and vinyl may be used.

What is claimed is:

1. A baby changing apparatus in a pillow comprising:

a pad unfolding lengthwise from a pocket to form a plurality of parallel, joined folding sections;

a pillow-forming section of the pad at a first end thereof having fabric defining the pocket;

a stowage section of the pad being one of the folding sections and having a first storage volume therein at least a center region of a folding section being padded; and the pad thinning where the folding sections join.

2. The baby changing apparatus in a pillow of claim 1 further comprising the pad being notched where the folding sections join.

3. A baby changing apparatus in a pillow comprising:

a flexible pad with a plurality of parallel folding sections joined and folding at fold lines;

a pillow-forming section of the pad at a first end thereof openable towards an opposing second end of the pad;

a stowage section of the pad being a one of the folding sections and having a first storage volume and a second storage volume; and the opened pillow-forming section receiving the remaining folding sections folded and inserted to form a pillow, at least a folding section having a resilient material between a first surface of the pad and an opposing second surface of the pad; and the first and second surfaces of the pad being attached between the folding sections, proximate to the fold lines.

4. The baby changing apparatus in a pillow of claim 3 further comprising the first storage volume having a sealable lid and being configured to removably contain baby wipes.

5. The baby changing apparatus in a pillow of claim 3 further comprising the pad having notches along opposing edges at the fold lines.

6. A baby changing apparatus in a pillow comprising:

a flexible baby changing pad unfolding lengthwise from a pocket to form a plurality of parallel folding sections joined and folding at fold lines;

a pillow-forming section of the pad at a first end thereof having fabric defining the pocket and being openable towards an opposing second end of the pad;

a stowage section of the pad being a one of the folding sections at the second end of the pad and having a first storage volume and a second storage volume;

at least a middle section of the pad being a further one of the folding sections; and the pad folding such that the opened pillow-forming section receives the residual folding sections tucked into the pocket to form the pillow;

at least a folding section having a foam sheet between a first surface of the pad and an opposing second surface of the pad; and stitching between the folding sections and through the first and second surfaces of the pad, defining the fold lines and at least partially securing the foam sheet.

7. The baby changing apparatus in a pillow of claim 6 further comprising the first storage volume having a hinged, sealable lid and being configured to contain and dispense baby wipes.

* * * * *